US006023207A

United States Patent [19]

Ito et al.

[11] Patent Number: 6,023,207

[45] Date of Patent: Feb. 8, 2000

[54] DIELECTRIC FILTER AND METHOD FOR ADJUSTING RESONANCE FREQUENCY OF THE SAME

[75] Inventors: Kenji Ito; Seigo Hino, both of Nagoya, Japan

[73] Assignee: NGK Spark Plug Co., Ltd., Japan

[21] Appl. No.: 08/796,890

[22] Filed: Feb. 5, 1997

[30] Foreign Application Priority Data

Feb. 9, 1996 [JP] Japan ..... 8-048056

[51] Int. Cl.[7] ..... H01D 1/205

[52] U.S. Cl. ..... 333/206; 333/207; 333/203

[58] Field of Search ..... 333/202, 206, 333/207, 222, 223, 203

[56] References Cited

U.S. PATENT DOCUMENTS

| | | | |
|---|---|---|---|
| 4,506,241 | 3/1985 | Makimoto et al. | 333/206 X |
| 4,523,162 | 6/1985 | Johnson | 333/204 X |
| 4,733,208 | 3/1988 | Ishikawa et al. | 333/202 |
| 4,757,284 | 7/1988 | Ueno | 333/206 X |
| 5,124,676 | 6/1992 | Ueno | 333/222 X |
| 5,406,236 | 4/1995 | Newell et al. | 333/206 |
| 5,436,602 | 7/1995 | McVeety et al. | 333/206 |
| 5,499,004 | 3/1996 | Noguchi et al. | 333/206 X |
| 5,512,866 | 4/1996 | Vangala et al. | 333/134 |
| 5,528,204 | 6/1996 | Hoang et al. | 333/134 |
| 5,652,555 | 7/1997 | Tada et al. | 333/206 X |

FOREIGN PATENT DOCUMENTS

| | | | |
|---|---|---|---|
| 59-14402 | 1/1984 | Japan . | |
| 60-98902 | 7/1985 | Japan . | |
| 61-52003 | 3/1986 | Japan . | |
| 62-38601 | 2/1987 | Japan | 333/202 |
| 2-92001 | 3/1990 | Japan | 333/206 |
| 4-200101 | 7/1992 | Japan . | |
| 5-37203 | 2/1993 | Japan . | |
| 6-90104 | 3/1994 | Japan . | |
| 7-283604 | 10/1995 | Japan . | |
| 2 163 606 | 2/1986 | United Kingdom . | |
| 85/00929 | 2/1985 | WIPO . | |

OTHER PUBLICATIONS

Patent Abstracts of Japan, vol. 16, No. 453 (E–1267), Sep. 21, 1992 & JP 04 160901 A (Fuji Electrochem Co Ltd), Jun. 4, 1992, * Abstract *.

Patent Abstracts of Japan, vol. 14, No. 288 (E–0943), Jun. 21, 1990 & JP 02 092001 A (Murata MFG Co Ltd), Mar. 30, 1990, * Abstract *.

Patent Abstracts of Japan, vol. 11, No. 314 (E–549), Oct. 13, 1987 & JP 62 108601 A (Matsushita Electric Ind Co Ltd), May 19, 1987, * Abstract *.

Patent Abstracts of Japan, vol. 11, No. 143 (E–504), May 9, 1987 & JP 61 280101 A (Murata MFG Co Ltd), Dec. 10, 1986, * Abstract *.

*Primary Examiner*—Seungsook Ham
*Attorney, Agent, or Firm*—Larson & Taylor

[57] ABSTRACT

A dielectric filter having a plurality of dielectric coaxial resonators provided on a dielectric ceramic block, which is capable of equalizing the resonance frequencies of all the dielectric coaxial resonators with ease, and a method for adjusting the resonance frequency of the dielectric filter, in which one or more counterbores is provided for adjusting the substantial resonance frequency of each of the dielectric coaxial resonators or for coping with a tendency toward any deviation of the resonance frequency based on the structure of the dielectric filter. Each counterbore has a diameter larger than that of an inner conductor of each of the dielectric coaxial resonators.

2 Claims, 6 Drawing Sheets

DIELECTRIC FILTER AND METHOD FOR ADJUSTING RESONANCE FREQUENCY OF THE SAME

BACKGROUND OF THE INVENTION

1. Field of the Invention

This invention relates to a dielectric filter comprising a plurality of dielectric coaxial resonators and a method of adjusting the resonance frequency of the same.

2. Prior Art

There have been proposed various types of dielectric filters, each comprising a plurality of dielectric coaxial resonators juxtaposed in a dielectric ceramic block or substrate in which through holes are formed in the dielectric block in an axial direction, an inner conductive film is provided on the interior wall of each of the through holes for forming an inner conductor, one end of each of the inner conductors is connected to an outer conductive film provided on the outer peripheral surface of the dielectric ceramic block for forming a short-circuit end, and the other end of each inner conductor is separated from the outer conductive film for forming an open-circuit end. These dielectric filters may be in general divided into two groups: one having capacity-coupling input/output terminals as shown in FIG. 1 and the other having magnetic field-coupling input/output terminals as shown in FIG. 2.

In a conventional dielectric filter f1 comprising capacitive-couping input/output terminals e1 which are capacitively coupled to respective outer dielectric coaxial resonators y as shown in FIG. 1, ends of the right and left dielectric coaxial resonators y are made relatively longer than that of the central dielectric coaxial resonator x to adjust the resonance frequency of each dielectric coaxial resonator. That is, as disclosed in Japanese U.M. Kokai No. 60-98902, in this dielectric filter f1, the resonance frequency of each of the dielectric coaxial resonators y disposed on both sides of the dielectric coaxial resonator x is liable to shift to a higher value than that of the dielectric coaxial resonator x. Then, the dielectric coaxial resonators y are extended at ends (lower ends in the figure) to increase the resonance lengths thereof so as to adjust the resonance frequencies thereof.

In an another conventional dielectric filter f2 comprising magnetic field-coupling input/output terminals e2 field coupled to respective outer dielectric coaxial resonators y through conductive through holes, as shown in FIG. 2, one end of the central dielectric coaxial resonator x is made relatively longer than that of right and left dielectric coaxial resonators y to adjust the resonance frequency thereof. That is, with this dielectric filter f2, the resonance frequency of the dielectric coaxial resonators y on both sides of the central dielectric coaxial resonator x are liable to shift to a lower value than that of the central dielectric coaxial resonator x. Then, the resonators y are shortened at lower ends in the figure to adjust the resonance frequency thereof.

The above mentioned dielectric filters f1 and f2 of FIGS. 1 and 2 are of an inter-digital structure in which the directions of the dielectric coaxial resonators are opposite to one another alternately. In such inter-digital type dielectric filters, short-circuit ends appear alternately on one-end side. Therefore, when the short-circuit ends are to be formed, it is necessary to form a conductive layer of a predtermined pattern by means of screen printing or immersion coating or plating after a portion around the open-circuit end is masked by screen printing because such a conductive layer cannot be formed by coating all over the surface or immersion coating on one end side.

However, in the above arrangements that one ends of the outer resonators and one end of the central resonator are extended, uneven surfaces z1 and z2 having a level difference of several millimeters are formed on lower end sides in the figures of the dielectric filters f1 and f2, respectively. Therefore, when a desired pattern is to be formed by thick-film printing or plating with masking, the uneven surfaces make printing difficult and thereby uniform coated surfaces cannot be obtained with the result of a low yield. When screen printing is carried out on these uneven surfaces, the screen may be easily broken by the level differences of the uneven surfaces at the time of printing.

Further, in the case where polishing is carried out to adjust resonance length for a sintered ceramic, to obtain a predetermined degree of input/output coupling, a polishing step becomes complicated because a smooth surface formed near the input/output terminal cannot be polished and the above uneven surface needs to be polished but cannot be ground or polished uniformly. As a result, this causes an increase in the number of steps.

Meanwhile, such arrangement that facilitates the adjustment of resonance length is required not only for the above inter-digital structure but also a comb-shaped structure in which short-circuit ends and open-circuit ends are located on the same sides, respectively.

It is therefore an object of the present invention to solve the above problems and thus to provide a dielectric filter which is capable of equalizing the resonance frequencies of all the dielectric coaxial resonators with ease and a method for adjusting the resonance frequency of such dielectric filter.

SUMMARY OF THE INVENTION

According to one aspect of the present invention, there is provided a dielectric filter including a plurality of dielectric coaxial resonators provided on a dielectric ceramic block, in which a plurality of through holes are provided to be extended in parallel to each other from one end surface to the other end surface opposite to said one end surface of the dielectric ceramic block, each of said through holes has an inner surface provided with an inner conductive layer for forming a resonance conductor, each of said resonance conductors has one end connected to an outer conductive layer formed on the outer peripheral surface of the dielectric block to form a short-circuit end and the other end separated from said outer conductive layer to form an open-circuit end, and capacitive coupling or electromagnetic field coupling input/output terminals are provided on the dielectric ceramic block wherein at least one counterbore is provided on one end portion of the resonance conductor of each of the dielectric coaxial resonators for adjusting the substantial resonance length of the resonance frequency of each of the dielectric coaxial resonators, and each spot facing or counterbore has a diameter as large as that of the resonance conductor of each of the dielectric coaxial resonators.

According to second aspect of the present invention, there is provided a method of adjusting a resonance frequency of a dielectric filter including a plurality of dielectric coaxial resonators provided on a dielectric ceramic block, in which a plurality of through holes are provided to be extended in parallel to each other from one end surface to the other end surface opposite to said one end surface of the dielectric ceramic block, each of said through holes has an inner surface provided with an inner conductive layer for forming a resonance conductor, each of said resonance conductors has one end connected to an outer conductive layer formed on the outer peripheral surface of the dielectric block to form a short-circuit end and the other end separated from said outer conductive layer to form an open-circuit end, and capacitive coupling or electromagnetic field coupling input/output terminals are provided on the dielectric ceramic block, wherein the method comprising the step of forming at least or counterbore having a diameter as large as the resonance conductor on a mouth of the resonance conductor of each of the dielectric coaxial resonators so as to adjust the resonance frequency of each of the dielectric coaxial resonators.

With the dielectric filter according to the present invention, in case each counterbore is provided on the open-circuit end of the inner conductor of the respective dielectric coaxial resonator, an area of the inner conductive layer formed on the interior surface of each counterbore becomes larger than other portions of the inner conductor, whereby the length of the inner conductor is extended and hence, the resonance length is substantially increased. This means that impedance is partially reduced and the resonance frequency is lowered. In this case, as a matter of course, the larger the inner diameter and depth of each counterbore the lower the resonance frequency becomes.

Meanwhile, in case each counterbore is provided on the short-circuit end of the inner conductor of the respective dielectric coaxial resonator, the inner conductive layer formed on the interior surface of each counterbore becomes a part of a connection conductor, whereby the resonance length is substantially shortened and the resonance frequency becomes higher.

Each of the above functions is particularly advantageous for a dielectric filter comprising three or more dielectric coaxial resonators.

In the dielectric filter comprising capacitive coupling input/output terminals capacitively coupled to the outermost dielectric coaxial resonators, since the resonance frequencies of the outermost dielectric coaxial resonators are liable to shift to a relatively high value, the counterbores are provided on the mouths of the open-circuit ends of the inner conductors of the outermost dielectric coaxial resonators for increasing the resonance lengths of these resonators substantially so as to lower their resonance frequencies. Thus, it is possible to equalize the resonance frequencies of all the dielectric coaxial resonators. Alternatively, one or more counterbores may be provided on the mouth of the short-circuit end of the inner conductor of one or more inner positioned dielectric coaxial resonators for increasing the resonance frequency thereof so as to equalize the resonance frequencies of all the dielectric coaxial resonators.

In the dielectric filter comprising electromagnetic field-coupling input/output terminals which are coupled by electromagnetic field-coupling to the outermost dielectric coaxial resonators through conductive through holes, since the resonance frequencies of the outermost dielectric coaxial resonators are liable to shift to a relatively low value, one or more counterbores are formed in the mouth on the open-circuit end of the inner conductor of one or more inner positioned dielectric coaxial resonators to lower the resonance frequency thereof so as to equalize the resonance frequencies of all the dielectric coaxial resonators. In this case, alternatively the counterbores may be formed in the mouths on the short-circuit ends of the inner conductors of the outermost resonators to increase the resonance frequencies of these resonators to a relatively high value.

In this way, by forming one or more counterbores in advance in accordance with the structure of each input/output terminal it is possible to adjust the resonance frequencies of all the dielectric coaxial resonators which may tend to deviate so that the resonance frequencies can be equalized. Alternatively, each counterbore may be formed after the filter body is completed.

The differences of the resonance frequency among the coaxial resonators may be mainly caused by input/output coupling and inter-stage coupling. Therefore, for compensating for the differences, it is desired that the inner diameter of each counterbore should be 105 to 300% of that of the inner conductor and the depth should be 5 to 50% of the resonance length,

BRIEF DESCRIPTION OF THE DRAWINGS

The present invention will now be described more in detail, by way of example, with reference to the accompanying drawings, wherein.

DESCRIPTION OF THE PREFERRED EMBODIMENTS

Figure 1:
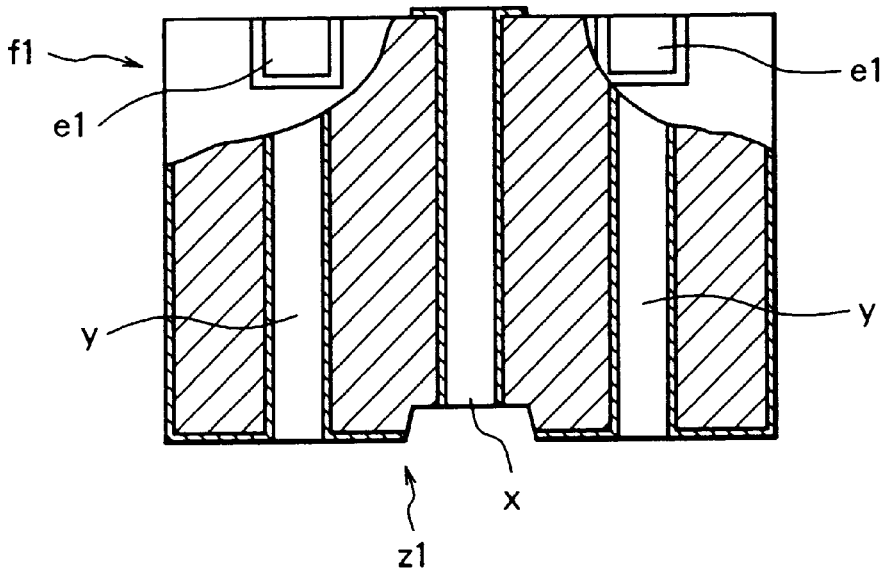
FIG. 1 PRIOR ART
FIG. 1 is a partially cutaway sectional view showing a conventional dielectric filter arrangement having capacity-coupling input/output terminals.
Figure 2:
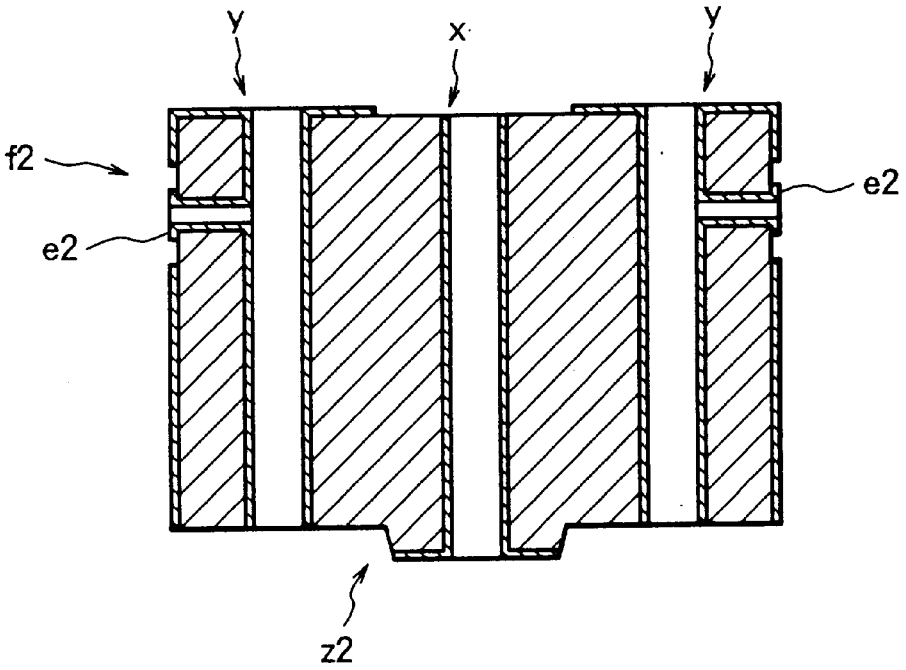
FIG. 2 PRIOR ART
FIG. 2 is a longitudinal section view showing another conventional dielectric filter arrangement having magnetic field-coupling input/output terminals.
Figure 3:
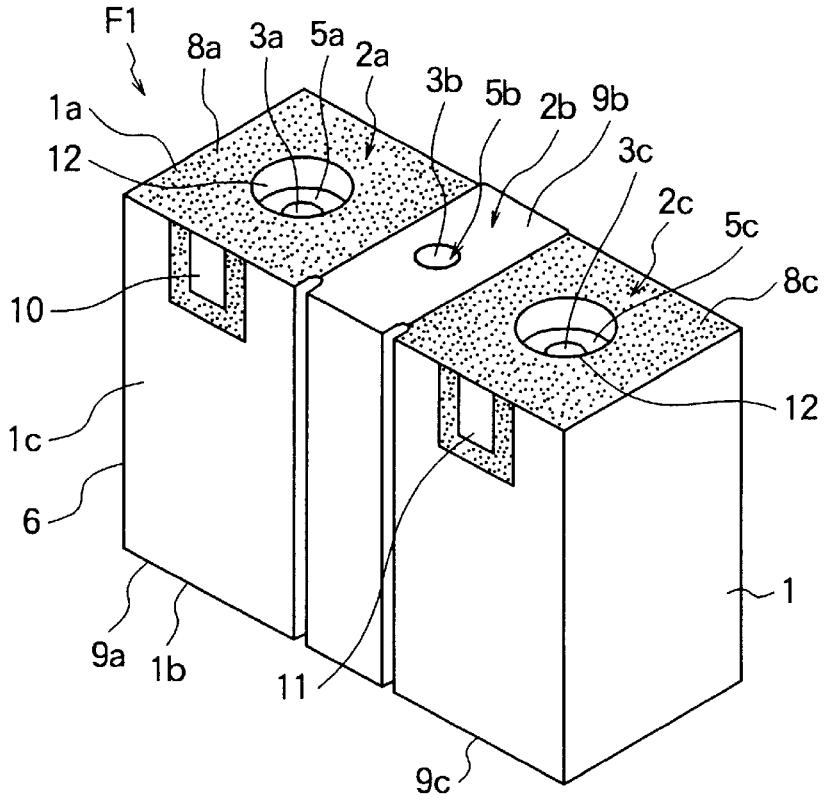
FIG. 3 is a perspective view showing a dielectric filter according to a first embodiment of the present invention.
Figure 4:
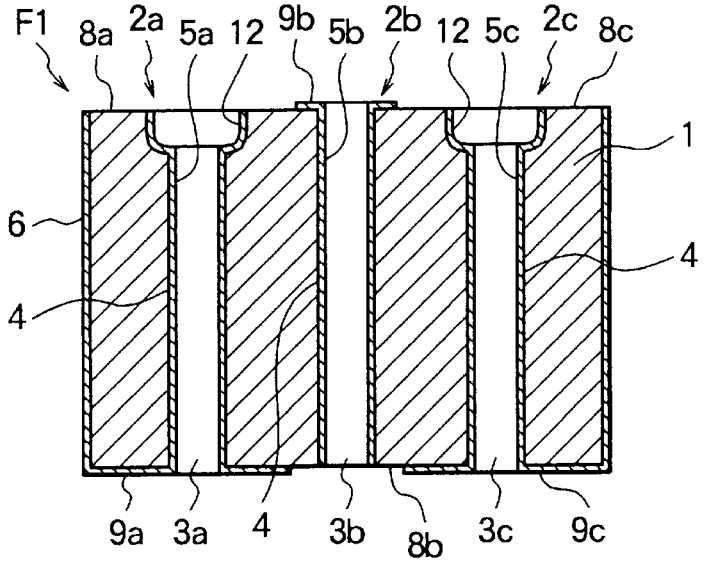
FIG. 4 is a longitudinal section view of the dielectric filter of FIG. 3.
Figure 5:
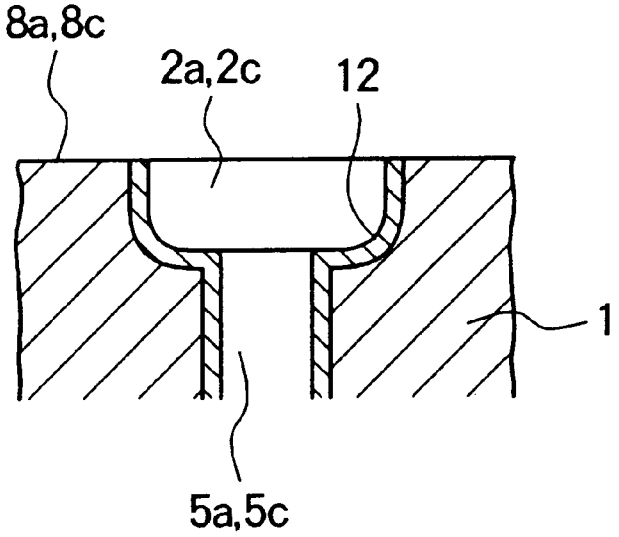
FIG. 5 is an enlarged sectional view showing a counterbore formed on an open-circuit end side of the dielectric filter of FIG. 3.

FIGS. 3 to 5 show a dielectric filter F1 having a single dielectric block 1 and three dielectric coaxial resonators 2*a*, 2*b* and 2*c* therein.

The dielectric block 1 is a titanium oxide-based ceramic dielectric of a rectangular parallelpiped shape and is provided with three through holes 3*a*, 3*b* and 3*c* for the dielectric coaxial resonators 2*a*, 2*b* and 2*c*. On the inner walls of the respective through holes 3*a*, 3*b* and 3*c* are provided inner conductive layers 4 for forming inner conductors 5*a*, 5*b* and 5*c*. Each inner conductive layer 4 may be formed by coating. Further, an outer conductive layer or earth conductor 6 is formed on the outer peripheral surface of the dielectric block 1. On one end surface 1*a* of the dielectric block 1 no conductive layer is provided on the portions surrounding the through holes 3*a* and 3*c* so that one end portions of the outermost resonators 2*a* and 2*c* on one end surface 1*a* of the dielectric block 1 form open-circuit ends 8*a* and 8*c*, and a connecting conductor layer is provided on the portion surrounding the central through holes 3*b* so that one end portion of the central resonator 2*b* forms short-circuit end 9*b*. On the other end surface 1*b* of the dielectric block 1 connecting conductor layers are provided on the portions surrounding the through holes 3*a* and 3*c* so that the other end portions of the outermost resonators 2*a* and 2*c* on the other end surface 1*b* of the dielectric block 1 form short-circuit ends 9*a* and 9*c*, and no conductive layer is provided on the portion surrounding the central through holes 3*b* so that the corresponding end portion of the central resonator 2*b* forms open-circuit end 8*b*.

Further, input/output terminals 10 and 11 are provided on one lateral surface 1*c* of the dielectric block 1 in such a manner that they are electrically insulated from the outer conductive layer 6. The input/output terminal 10 is arranged to face the inner conductor 5*a* so as to be capacitively coupled thereto and the input/output terminal 11 is arranged to face the inner conductor 5*c* so as to be capacitively coupled thereto.

A description is subsequently given of the key parts of the present invention.

In the dielectric filter F1 in which the input/output terminals 10 and 11 are capacitively coupled to the inner conductors 5*a* and 5*c*, respectively, the resonance frequency of each of the most lateral resonators 2*a* and 2*c* is liable to shift to a value higher than that of the intermediate resonator 2*b*. Then, in the present invention, to equalize the resonance frequencies of the dielectric coaxial resonators 2*a*, 2*b* and 2*c*, a counterbore 12 is formed on the mouth of each of the inner conductors 5*a* and 5*c* at the open ends 8*a* and 8*c* of the resonators 2*a* and 2*c* so that each counterbore 12 has an inner diameter larger than that of the inner conductor. On the inner wall of each counterbore 12 is provided a conductive layer which is connected to the associated inner conductor.

That is, as shown in FIG. 5, the inner diameter of the open circuit end portion of each of the inner conductors 5*a* and 5*c* are widened by forming the counterbores 12. With the provision of the counterbores 12 the inner conductive layer formed on the inner wall thereof is extended outwardly with the result of a substantial increase in the resonance length. Along with this, impedance is partially reduced and the resonance frequency is lowered. In this connection, the larger the inner diameter and depth of the respective counterbore 12 the lower the resonance frequency becomes. Therefore, the resonance frequency can be set to a desired value by adjusting the inner diameter and depth of the respective counterbore 12. Then, by previously providing such counterbores 12, the resonance frequencies of the outermost resonators 2*a* and 2*c* are adjusted to a lower value so as to make them equal to the resonance frequency of the intermediate resonator 2*b*.

Figure 6:
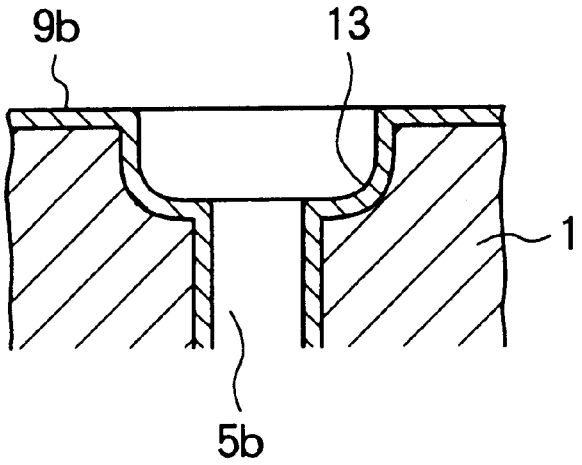
FIG. 6 is an enlarged sectional view showing a counterbore formed on a short-circuit end side of the dielectric filter of FIG. 3.

Alternatively, as shown in FIG. 6, a counterbore 13 may be formed on the end portion of the inner conductor 5*b* at the short-circuit end side of the intermediate resonator 2*b* to shorten the resonance length of the inner conductor 5*b*, whereby the resonance frequency of the inner conductor 5*b* is adjusted to a higher value so as to make it equal to the resonance frequencies of the inner conductors 5*a* and 5*c*.

The differences among the resonance frequencies of the coaxial resonators 2*a*, 2*b* and 2*c* may be mainly caused by input/output coupling and inter-stage coupling. Therefore, for compensating for these differences, it is desired that the inner diameter of each counterbore be 105 to 300% of that of the inner conductors 5*a*, 5*b* and 5*c* and the depth thereof be 5 to 50% of the resonance length.

Figure 7:
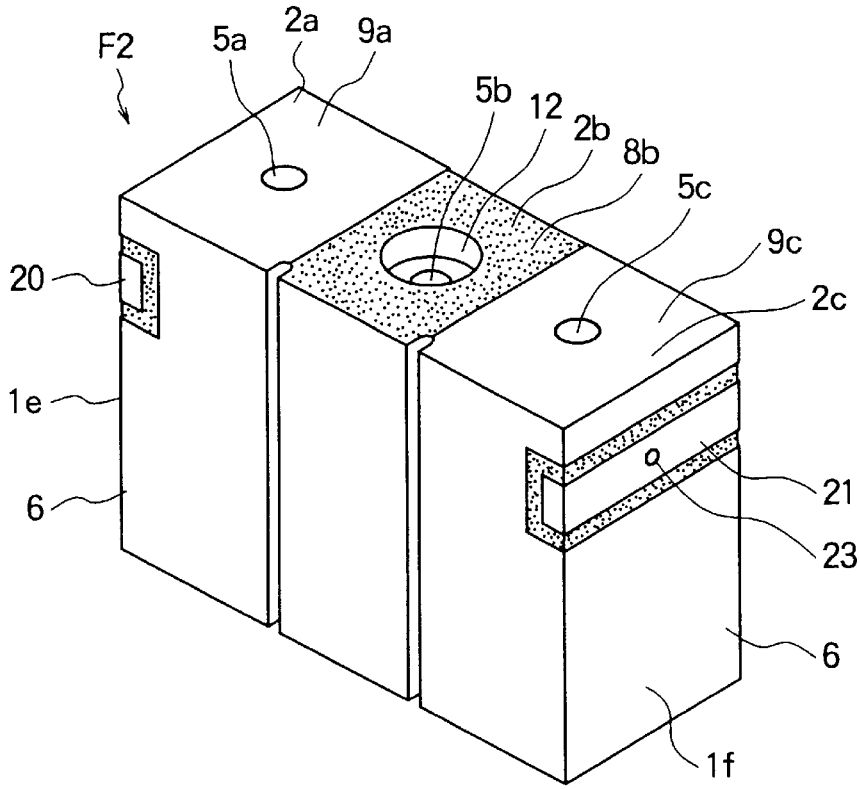
FIG. 7 is a perspective view showing a dielectric filter according to a second embodiment of the present invention.
Figure 8:
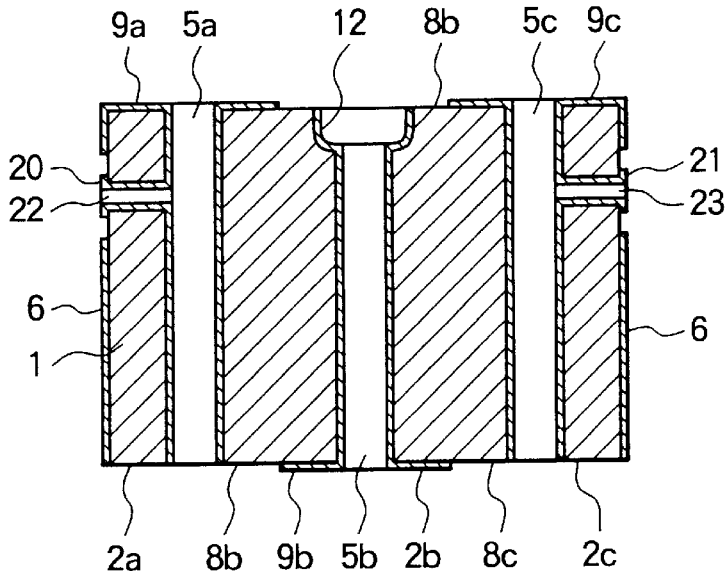
FIG. 8 is a longitudinal section showing the dielectric filter of FIG. 7.

FIGS. 7 and 8 illustrate an inter-digital type dielectric filter F2 according to a second embodiment of the present invention. The illustrated dielectric filter F2 has substantially the same constitution as that of the first embodiment excepting a provison of a magnetic field-coupling input/output terminals. In FIGS. 7 and 8, the same constituent elements as those of the above mentioned dielectric filter F1 are given the same reference numerals and thus the explanation of their details is omitted.

In the illustrated dielectric filter F2, the input/output terminals 20 and 21 are formed on the lateral surfaces 1*e* and 1*f* of the dielectric block 1 or the outermost resonators 2*a* and 2*c* in such a manner that they are insulated from the outer conductive layer 6. One of the input/output terminals 20 is connected to the inner conductor 5*a* through a conductive path formed in an electric conductive hole 22, and the other input/output terminal 21 is connected to the inner conductor 5*c* through a conductive path formed in an electric conductive hole 23. In this way, the input/output terminals 20 and 21 are coupled to the inner conductors 5*a* and 5*c* by means of an electromagnetic field coupling, respectively.

In the dielectric filter having electromagnetic field coupling type input/output terminals, the resonance frequencies of the outermost resonators 2*a* and 2*c* are liable to shift to a lower value than that of the intermediate resonator 2*b*. In order to equalize the resonance frequencies of the dielectric coaxial resonators 2*a*, 2*b* and 2*c*, a counterbore 12 as shown in FIG. 5 is formed on the mouth of the inner conductor 5*b* at the open-circuit end 8*b* of the resonators 2*b* so that the counterbore 12 has an inner diameter larger than that of the inner conductor. On the inner wall of the counterbore 12 is provided a conductive layer which is connected to the inner conductor 5*b* so that the resonance length of the resonator 2*b* is extended and thus the resonance frequency of the intermediate resonator 2*b* is reduced. Alternatively, the resonace frequency adjusting may be performed by forming counterbores 13 on the end portions of the inner conductors 5*a* and 5*c* at the short-circuit ends of the outermost resonators 2*a* and 2*c* to shorten the resonance length of each of the inner conductors 5*a* and 5*c*, in such a manner as shown in FIG. 6. In that case the resonance frequencies of the inner conductors 5*a* and 5*c* are adjusted to a higher value so as to make them equal to the resonance frequency of the inner conductor 5*b* of the intermediate resonator 2*b*.

Since the counterbore(s) 12 or 13 is formed to cope with a tendency toward the deviation of the resonance frequency based on the arrangement of the dielectric filter F1 or F2, unlike the arrangement of the prior art, it is not necessary to adjust the resonance length by forming an uneven surface on one end of the dielectric coaxial resonators and it is possible to obtain a rectangular dielectric filter without an uneven surface. Therefore, pattern printing can be carried out on both end surfaces of an inter-digital structured dielectric filter with ease.

Figure 9:
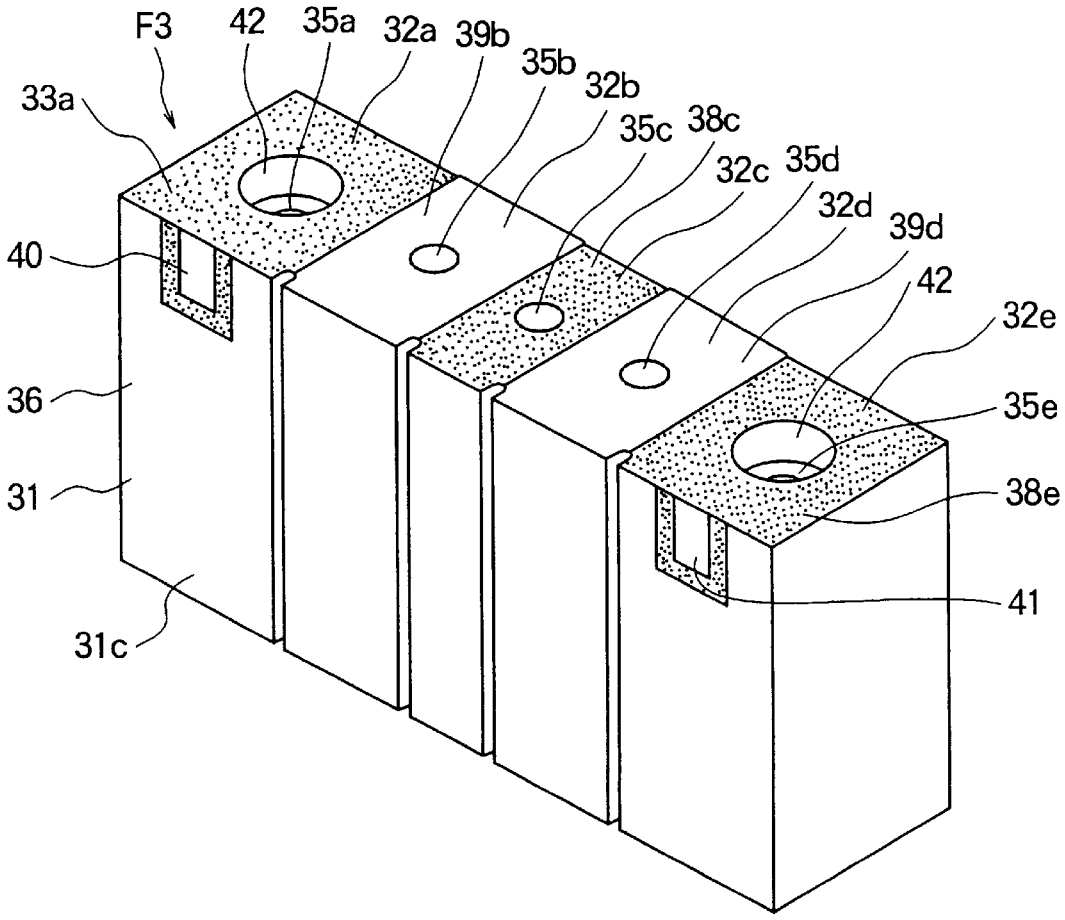
FIG. 9 is a perspective view showing a dielectric filter according to a third embodiment of the present invention.
Figure 10:
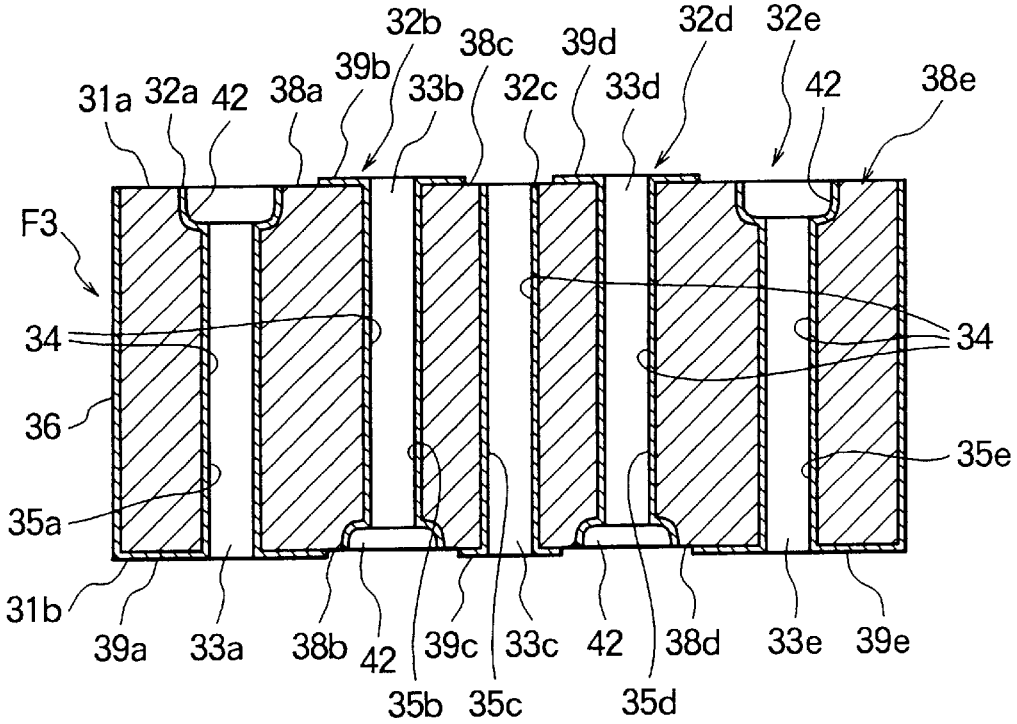
FIG. 10 is a longitudinal section showing the dielectric filter of FIG. 9.

Referring to FIGS. 9 and 10 there is illustrated a dielectric filter F3 having a 5-pole type inter-digital structure.

This dielectric filter F3 comprises a dielectric block 31 and five dielectric coaxial resonators 32*a*, 32*b*, 32*c*, 32*d* and 32*e* therein. The dielectric block 31 is a titanium oxide-based ceramic dielectric of a rectangular parallelpiped shape and is provided with five through holes 33*a*, 33*b*, 33*c*, 33*d* and 33*e* for the dielectric coaxial resonators 32*a*, 32*b*, 32*c*, 32*d* and 32*e*. Each of the respective through holes 33*a*, 33*b*, 33*c*, 33*d* and 33*e* has an inner wall coated with an inner conductive layers 34 to form inner conductors 35*a*, 35*b*, 35*c*, 35*d* and 35*e*. Further, the outer peripheral surface of the dielectric block 31 is provided with an outer conductive layer or earth conductor 36. On one end surface 31*a* of the dielectric block 31 the portions surrounding the through holes 33*a,* 33*c* and 33*e* have no conductive layer so that one end portions of the outermost resonators 32*a* and 32*e* and the intermediate resonator 32*c* on one end surface 31*a* of the dielectric block 31 form open-circuit ends 38*a,* 38*e* and 38*c,* and a connecting conductor layer is provided on the portion surrounding each of the through holes 33*b* and 33*d* so that one end portions of the resonators 32*b* and 32*d* form short-circuit ends 39*b* and 39*d.* On the other end surface 31*b* of the dielectric block 31 connecting conductor layers are provided on the portions surrounding the through holes 33*a,* 33*c* and 33*e* so that the other end portions of the outermost resonators 32*a* and 32*e* and the intermediate resonator 32*c* on the other end surface 31*b* of the dielectric block 31 form short-circuit ends 39*a,* 39*e* and 9*c,* respectively. No conductive layer is provided on the portions surrounding the through holes 33*b* and 33*d* so that the corresponding end portions of the resonators 32*b* and 32*d* form open-circuit ends 38*b* and 38*d.*

In this dielectric filter F3, input/output terminals 40 and 41 are formed on one lateral portion 31*c* of the dielectric block 31 in such a manner that they are insulated from the outer conductive layer 36, and arranged to face the inner conductors 35*a* and 35*e* of the outermost resonators 32*a* and 32*e.* In this way, the input/output terminals 40 and 41 are capacitively coupled to the inner conductors 32*a* and 32*e,* respectively.

It will now be described how the resonance frequency of the thus constructed dielectric filter F3 is adjusted.

Such dielectric filter has a tendency that the resonance frequency of each of the outermost resonators 32*a* and 32*e* may be shifted toward a value higher than that of the other resonators 32*b,* 32*c* and 32*d.*

In order to adjust the resonance frequency in the dielectric filter F3, counterbores 42 are provided in the mouths on the open-circuit ends 38*a,* 38*b,* 38*d* and 38*e* of the inner conductors 35*a,* 35*b,* 35*d* and 35*e.*

In order to equalize the resonance lengths of all the dielectric coaxial resonators 32*a,* 32*b,* 32*c,* 32*d* and 32*e* in this arrangement, the counterbores 42 formed at the open-circuit ends 38*a* and 38*e* of the inner conductors 35*a* and 38*e* should be larger in diameter or depth than the counterbores 42 formed at the open-circuit ends 38*b* and 38*d* of the inner conductors 35*b* and 35*d* so as to extend the resonance lengths of the outermost resonators 32*a* and 32*e.*

In this way, the substantial resonance lengths of the dielectric coaxial resonators are adjusted to increase from the center resonator to the outer resonator, and thus the resonance frequencies of the dielectric coaxial resonators are adjusted to decrease from the center resonator to the outer resonator. Therefore, all the resonance frequencies of the dielectric coaxial resonators become equal.

Figure 11:
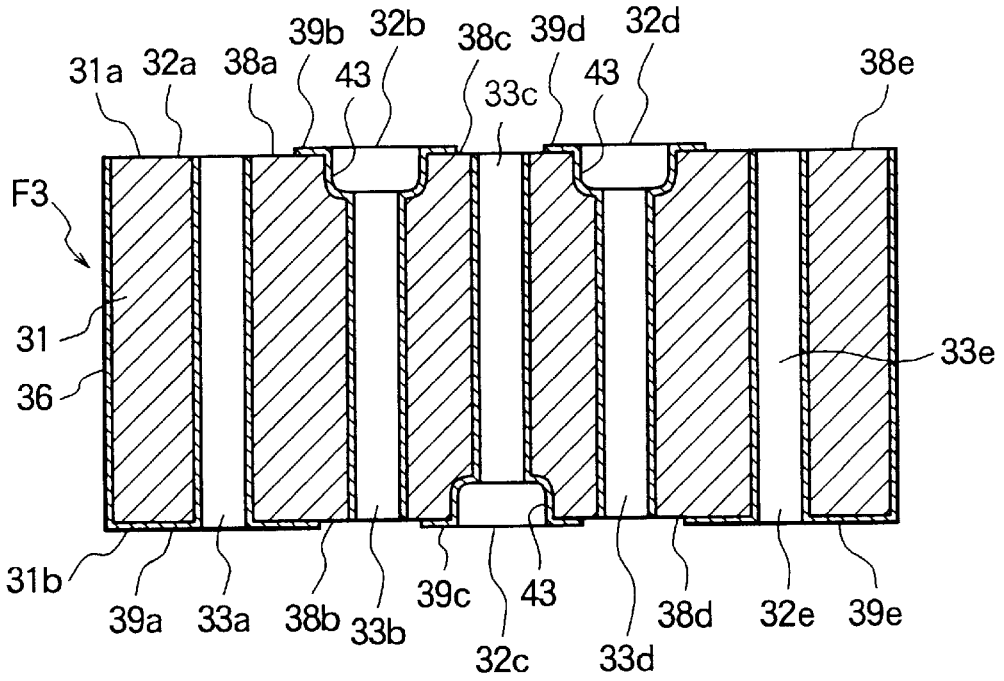
FIG. 11 is a longitudinal section showing a modification of the dielectric filter of FIG. 9.

In this arrangement, as shown in FIG. 11, the resonance frequency of the filter may also be adjusted by forming counterbores 43 in the mouths on the short-circuit ends 39*b,* 39*c* and 39*d* of the inner conductors 35*b,* 35*c* and 32*d* to increase the resonance frequencies of the resonators 32*b,* 32*c* and 32*d.* In this base, the counterbore 43 in the inner conductor 35*c* should be larger in diameter or depth than the counterbores 43 in the inner conductors 35*b* and 35*d.*

Alternatively, the resonance frequencies of all the dielectric coaxial resonators can be equalized by forming a counterbore on the short-circuit end of the dielectric coaxial resonator 32*c* to shorten the substantial resonance length thereof and counterbores on the open-circuit ends of the dielectric coaxial resonators 32*a* and 32*e.*

Furthermore, in case the dielectric filter F3 having a 5-pole inter-digital structure includes magnetic field coupling input/output terminals, counterbores may be formed around the mouths on the open-circuit ends of the inner conductors 35*b,* 35*c* and 35*d* of the dielectric coaxial resonators 32*b,* 32*c* and 32*d,* and the counterbore formed around the mouth on the open-circuit end of the inner conductor 35*c* may be made larger in diameter or depth than the counterbores formed in the inner conductors 35*b* and 35*d* to increase the resonance length of the intermediate resonator 32*c.* It should be appreciated that counterbores may be provided on the short-circuit ends of the inner conductors in the same manner as described above with regard to FIG. 11.

With the illustrated arrangements mentioned above, since the counterbores are formed in advance to compensate any prospected deviation of the resonance frequency based on the constitution of the dielectric filter, unlike the arrangement of the prior art, it is not necessary to adjust the substantial resonance lengths of the respective resonators by forming an uneven surface on one end of each dielectric coaxial resonator and thus it is possible to obtain a dielectric filter in the form of a rectangular parallelpiped without an uneven surface. Therefore, pattern printing can be carried out on both end surfaces of the inter-digital structured dielectric filter with ease.

It is also possible to adjust the resonance frequency of the dielectric filter after it is completed. That is, the resonance frequency of the filter can be adjusted by forming the counterbores on the open-circuit ends of the inner conductors for extending the substantial resonance length of each of them or forming the counterbores on the short-circuit ends of the inner conductors for shortening the substantial resonance length. Therefore, both means may be used to adjust the resonance frequency of the filter.

The illustrated embodiments employ an inter-digital structure in which short-circuit and open-circut ends of the respective resonators are arranged alternately on opposite sides. However, the present invention may be applied to a comb-shaped structure in which short-circuit ends and open-circuit ends are arranged on the same sides, respectively. Even in the comb-shaped structure, the resonance frequency can be adjusted with the provision of the counterbores.

According to the present invention, a counterbore(s) for adjusting the substantial resonance length of the resonance frequency of each of the dielectric coaxial resonators is formed around the open and/or short-end of the inner conductor of each of the dielectric coaxial resonators, and each counterbore has a diameter as large as that of the respective inner conductor. That is, with the provision of a spot facing(s) or counterbore(s) on the open-circuit end of the respective inner conductor for extending the resonance length and/or of a spot facing(s) or counterbore(s) on the short-circuit end of the respective inner conductor for shortening the resonance length it is possible to equalize the resonance frequencies of all the dielectric coaxial resonators in advance so as to cope with a tendency toward any prospected deviation of the resonance frequency based on the structure of a dielectric filter. Therefore, the resonance frequency of the filter can be easily adjusted and the polishing step for adjusting the degree of input/output coupling after sintering is made easy, thereby improving productivity.

Furthermore, in case of the inter-digital structure in which the short-circuit ends of the adjacent dielectric coaxial resonators appear at the opposite sides it is possible to form a dielectric filter into an uniform rectangular parallelpiped so that an uneven surface is not produced on one end thereof and to easily and uniformly carry out pattern printing on the end surface by means of screen printing or the like.

We claim:

1. A dielectric filter comprising:

a dielectric ceramic block having an outer conductive layer formed on an outer peripheral surface;

three or more dielectric coaxial resonators provided in parallel to each other on a dielectric ceramic block, each said resonator including (a) a through hole provided to be extended from one end surface to the other end surface opposite to said one end surface of the dielectric ceramic block and (b) an inner conductive layer provided on an inner surface of the through hole for forming a resonance conductor, each of said resonance conductors having one end connected to the outer conductive layer to form a short-circuit end and the other end separated from said outer conductive layer to form an open-circuit end;

electromagnetic field coupling input/output terminals provided on said dielectric ceramic block, with which outermost resonators of said dielectric coaxial resonators are electromagnetically coupled; and at least one counterbore provided on the open-circuit end of the resonance conductor of at least one dielectric coaxial resonator other than the outermost dielectric coaxial resonators electromagnetically coupled with said input/output terminals for extending the resonant length of that dielectric coaxial resonator, each said counterbore including (a) a conductive layer on an inner wall thereof which is connected to the associated resonance conductor, and (b) having a diameter larger than that of the resonance conductor of each of the dielectric coaxial resonators.

2. A method of adjusting a resonance frequency of a dielectric filter including three or more dielectric coaxial resonators provided to be extended in parallel to each other on a dielectric ceramic block, in which each said resonator includes a through hole provided to be extended from one end surface to the other end surface opposite to said one end surface of the dielectric ceramic block and an inner conductive layer for forming a resonance conductor, each of said resonance conductors has one end connected to an outer conductive layer formed on the outer peripheral surface of the dielectric block to form a short-circuit end and the other end separated from said outer conductive layer to form an open-circuit end, and electromagnetic field coupling input/output terminals are provided on said dielectric ceramic block to be electromagnetically coupled to two of the resonators, wherein the method comprises the steps of:

forming at least one counterbore each having a diameter larger than that of the resonance conductor on the open-circuit end of the resonance conductor of at least one of the dielectric coaxial resonator other than the resonators electromagnetically coupled with the input/output terminals; and forming a conductive layer on an inner wall of the respective counterbore so as to extend the resonant length of each of the dielectric coaxial resonators.

* * * * *